US007273388B2

(12) United States Patent
Kumakura

(10) Patent No.: US 7,273,388 B2
(45) Date of Patent: Sep. 25, 2007

(54) WIRING HARNESS, CONNECTOR, AND METHOD OF ASSEMBLING THE WIRING HARNESS

(75) Inventor: Hideto Kumakura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/358,313

(22) Filed: Feb. 22, 2006

(65) Prior Publication Data

US 2006/0246768 A1 Nov. 2, 2006

(30) Foreign Application Priority Data

Apr. 27, 2005 (JP) ..... 2005-129216

(51) Int. Cl.
*H01R 4/24* (2006.01)

(52) U.S. Cl. ..... 439/422

(58) Field of Classification Search ..... 439/421, 439/422, 877, 310; 174/84 C; 29/861, 863
See application file for complete search history.

(56) References Cited

U.S. PATENT DOCUMENTS 3,697,925 A * 10/1972 Henschen ..... 439/494
3,924,917 A * 12/1975 Munshower ..... 439/422
6,626,695 B2 * 9/2003 Enomoto et al. ..... 439/422
6,652,310 B2 * 11/2003 Onuma ..... 439/422

FOREIGN PATENT DOCUMENTS

JP 2549583 Y2 6/1997
JP 2002-334617 A 11/2002

* cited by examiner

*Primary Examiner*—Khiem Nguyen
(74) *Attorney, Agent, or Firm*—Sughrue Mion, PLLC

(57) ABSTRACT

Providing a method of assembling a wiring harness and the wiring harness and a connector allowable to reduce required hours and a cost for assembling the wiring harness, the wiring harness includes a FFC and the connector. The FFC has a plurality of conductors and an insulator covering the conductors. The connector has piercing terminals, a connector housing and a cover. The piercing terminal has claws. A plurality of piercing terminals is received in the connector housing. The connector housing and the cover are provided with separating walls for clamping only the insulators of the FFC. By inserting the plurality of piercing terminals into the connector housing, making the claws pierce through the FFC, and bending the claws, the wiring harness is assembled.

10 Claims, 10 Drawing Sheets

WIRING HARNESS, CONNECTOR, AND METHOD OF ASSEMBLING THE WIRING HARNESS

The priority application Number Japan Patent Application 2005-129216 upon which this patent application is based is hereby incorporated by reference.

BACKGROUND OF THE INVENTION

1. Field of the Invention

This invention relates to a method of assembling a wiring harness having a flat circuit body, such as a FPC (Flexible Printed Circuit) and a FFC (Flexible Flat Cable), and the wiring harness and a connector to be connected with the flat circuit body.

2. Description of the Related Art

Various electronic apparatuses are installed in a car as a vehicle. In the car, a wiring harness is wired for transmitting electric power and control signals. The wiring harness includes a FCC as the flat circuit body and a connector.

The flat circuit body has a conductor with a rectangular cross-section and a film-shape insulator for covering the conductor. A plurality of conductors is arranged in the flat circuit body. Each conductor extends linearly. The plurality of conductors is arranged in parallel to each other. The insulator insulates the conductors to each other.

The connector has a connector housings and terminals. The terminal is formed by bending a conductive sheet metal. The terminal integrally includes an electric contact portion to be in contact with a mating terminal and a wire connecting portion to be joined with the conductor of the FFC. The wire connecting portion has a base plate and a plurality of claws standing from the base plate. The claws pierce the conductor and the insulator of the FFC piled on the base plate, and are bent toward the base plate, so that the wire connecting portion is connected with the conductor of the FFC.

The connector housing made of insulating synthetic resin is formed into a flat rectangular parallelepiped. The connector housing includes a plurality of terminal receiving sections for receiving terminals respectively.

The wiring harness is assembled as following steps. Each terminal is separated one by one from a plurality of terminals connected in a chain shape. The terminal is connected with the FFC. The terminals connected with the FFC are inserted into the terminal receiving sections of the connector housing. Thus, the wiring harness is assembled.

SUMMARY OD THE INVENTION

Objects to be Solved

Since a usual method of assembling the wiring harness is by that the terminals are connected one by one with the FFC, and the terminals connected with the FFC are inserted one by one into the connector housing, long hours are required to assemble the connector, that is wiring harness. Thereby, working efficiency of assembling the wiring harness comes down.

Since the terminals are connected one by one with the FFC, a tooling for connecting the terminal and the FFC is required to have a similar dimension as the terminal. Thereby, the tooling is miniaturized to reduce mechanical strength of the tooling, and a life of the tooling is shortened. Therefore, frequency of changing the tooling increases, so that cost of connecting the terminal and the FFC, that is assembling the wiring harness, increased.

To overcome the above problems, objects of this invention are to provide a method of assembling a wiring harness, the wiring harness, and a connector, which can reduce a required hours and cost for assembling the wiring harness.

How to attain the object of the present invention

In order to attain the objects of the present invention, a method of assembling a wiring harness, which includes a flat circuit body having a conductor and an insulator covering the conductor, a terminal having a wire connecting portion to be connected with the conductor of the flat circuit body, and a connector housing to receive a plurality of the terminals, includes the steps of inserting the plurality of terminals into the connector housing, piling the flat circuit body on the wire connecting portions of the plurality of terminals, making a claw of the wire connecting portion pierce into the conductor of the flat circuit body, and bending the claw so as to connect the plurality of terminals inserted in the connector housing and the flat circuit body.

The method of assembling a wiring harness according to the present invention is further characterized in the method of assembling a wiring harness claimed above in that the connector housing has a cutout exposing the wire connecting portions of the terminals inserted in the connector housing.

A wiring harness according to the present invention includes a flat circuit body having a conductor and an insulator covering the conductor, and a terminal having a wire connecting portion to be connected with the conductor of the flat circuit body. The wire connecting portion has a claw and a connector housing to receive a plurality of said terminals. The plurality of terminals is inserted into the connector housing. The flat circuit body is piled on the wire connecting portions of the plurality of terminals. The claw of the wire connecting portion pierces into the conductor of the flat circuit body, and the claw is bent so as to connect the plurality of terminals inserted in the connector housing and the flat circuit body.

The wiring harness according to the present invention is further characterized in the wiring harness mentioned above by that the connector housing has a positioning member for positioning the flat circuit body in a position allowable to connect each conductor and the wire connecting portion of the terminal.

The wiring harness according to the present invention is further characterized in the wiring harness claimed above by further including a cover mounted on the connector housing for covering the wire connecting portion of the terminal connected with the flat circuit body. The connector housing and the cover are provided respectively with a clamping portion to clamp only the insulator of the flat circuit body therebetween.

The wiring harness according to the present invention is characterized in the wiring harness claimed above in that the clamping portions of plural number are provided at the connector housing and the clamping portions of plural number are provided at the cover.

The wiring harness according to the present invention is characterized in the wiring harness claimed above in that each clamp portion provided at the connector housing and each clamp portion provided at the cover extend along lengthwise of the conductor of the flat circuit body.

The wiring harness according to the present invention is further characterized in the wiring harness claimed above in that the connector housing has a cutout exposing the wire connecting portions of the terminals inserted in the connector housing.

A connector according to the present invention includes a terminal having a wire connecting portion to be connected with a conductor of a flat circuit body and a connector housing capable to receive a plurality of the terminals. The connector housing includes a positioning member for positioning the flat circuit body in a position allowable to connect each conductor and the wire connecting portion of the terminal.

The connector according to the present invention is characterized in the connector claimed above by further including a cover mounted on the connector housing for covering the wire connecting portion of the terminal connected with the flat circuit body. The connector housing and the cover are provided respectively with a clamping portion to clamp only the insulator of the flat circuit body therebetween.

The connector according to the present invention is further characterized in the connector claimed above in that the clamping portions of plural number are provided at the connector housing and the clamping portions of plural number are provided at the cover.

The connector according to the present invention is further characterized in the connector claimed above in that each clamp portion provided at the connector housing and each clamp portion provided at the cover extend linearly along lengthwise of the conductor of the flat circuit body.

The connector according to the present invention is further characterized in the connector claimed above in that the connector housing has a cutout exposing the wire connecting portions of the terminals inserted in the connector housing.

EFFECTS OF THE INVENTION

According to the invention, since the flat circuit body is connected in one lump with the wire connecting portions of the plurality of terminals inserted in the connector housing, required hours for connecting the flat circuit body to the wire connecting portion of the terminals, that is assembling the wiring harness, can be extremely shortened.

Since the flat circuit body is connected in one lump with the wire connecting portions of the plurality of terminals, size of the tooling used for connecting the flat circuit body to the wire connecting portions of the terminals can be increased similarly as that of combining the plurality of terminals. Thereby, the mechanical strength of the tooling can be improved and the working life of the tooling can be extended. Therefore, frequency of changing the tooling can be reduced, and cost for assembling the wiring harness can be reduced.

Since the connector housing is further provided with a cutout exposing the wire connecting portions of the terminals inserted in the connector housing, by piling the flat circuit body on the wire connecting portions of the terminals and pressing the flat circuit body toward the wire connecting portions, the flat circuit body can be connected with the wire connecting portions. Therefore, without removing the insulator between adjacent conductors at a front end of the flat circuit body, the flat circuit body can be connected with the terminals. Thereby, required hours for connecting the flat circuit body to the wire connecting portion of the terminals, that is assembling the wiring harness, can be extremely shortened.

According to the invention, since the flat circuit body is connected in one lump with the wire connecting portions of the plurality of terminals inserted in the connector housing, required hours for connecting the flat circuit body to the wire connecting portion of the terminals, that is assembling the wiring harness, can be extremely shortened.

Since the flat circuit body is connected in one lump with the wire connecting portions of the plurality of terminals, size of the tooling used for connecting the flat circuit body to the wire connecting portions of the terminals can be increased similarly as that of combining the plurality of terminals. Thereby, the mechanical strength of the tooling can be improved and the working life of the tooling can be extended. Therefore, frequency of changing the tooling can be reduced, and cost for assembling the wiring harness can be reduced.

Since the connector housing is further provided with a cutout exposing the wire connecting portions of the terminals inserted in the connector housing, by piling the flat circuit body on the wire connecting portions of the terminals and pressing the flat circuit body toward the wire connecting portions, the flat circuit body can be connected with the wire connecting portions. Therefore, without removing the insulator between adjacent conductors at a front end of the flat circuit body, the flat circuit body can be connected with the terminals. Thereby, required hours for connecting the flat circuit body to the wire connecting portion of the terminals, that is assembling the wiring harness, can be extremely shortened.

According to the invention, since the flat circuit body is prevented from displacing from the connector housing, each conductor of the flat circuit body can be connected securely with the wire connecting portion of each terminal.

According to the invention, since relative displacement between the connector housing and the flat circuit body can be prevented from transmitting to a connecting point of the conductor of the flat circuit and terminal, the conductors of the flat circuit body can be connected securely with the terminals and unstable connection thereof can be prevented.

According to the invention, since relative displacement between the connector housing and the flat circuit body can be prevented securely from transmitting to a connecting point of the conductor of the flat circuit and terminal, the conductors of the flat circuit body can be connected securely with the terminals and unstable connection thereof can be prevented securely.

According to the invention, since contact area of the clamp and the insulator of the flat circuit body can be increased, and the relative displacement between the connector housing and the flat circuit body can be prevented more securely from transmitting to a connecting point of the conductor of the flat circuit and terminal, the conductors of the flat circuit body can be connected more securely with the terminals and unstable connection thereof can be prevented more securely.

According to the invention, since displacement between the connector housing and the flat circuit body can be prevented, each conductor of the flat circuit body can be connected securely with each terminal.

According to the invention, since relative displacement between the connector housing and the flat circuit body can be prevented from transmitting to a connecting point of the conductor of the flat circuit and terminal, the conductors of the flat circuit body can be connected securely with the terminals and unstable connection thereof can be prevented.

According to the invention, since relative displacement between the connector housing and the flat circuit body can be securely prevented from transmitting to a connecting point of the conductor of the flat circuit and terminal, the conductors of the flat circuit body can be connected securely with the terminals and unstable connection thereof can be prevented securely.

According to the invention, since contact area of the clamp and the insulator of the flat circuit body can be increased, the relative displacement between the connector housing and the flat circuit body can be prevented securely from transmitting to the connecting point of the conductor of the flat circuit and terminal. Therefore, the conductors of the flat circuit body can be connected more securely with the terminals and unstable connection thereof can be prevented more securely.

The above and other objects and features of this invention will become more apparent from the following description taken in conjunction with the accompanying drawings.

DESCRIPTION OF THE PREFERRED EMBODIMENT

A wiring harness, a connector and a method of assembling the wiring harness of each embodiment according to the present invention will be described with reference to FIGS. 1-10.

Figure 1:
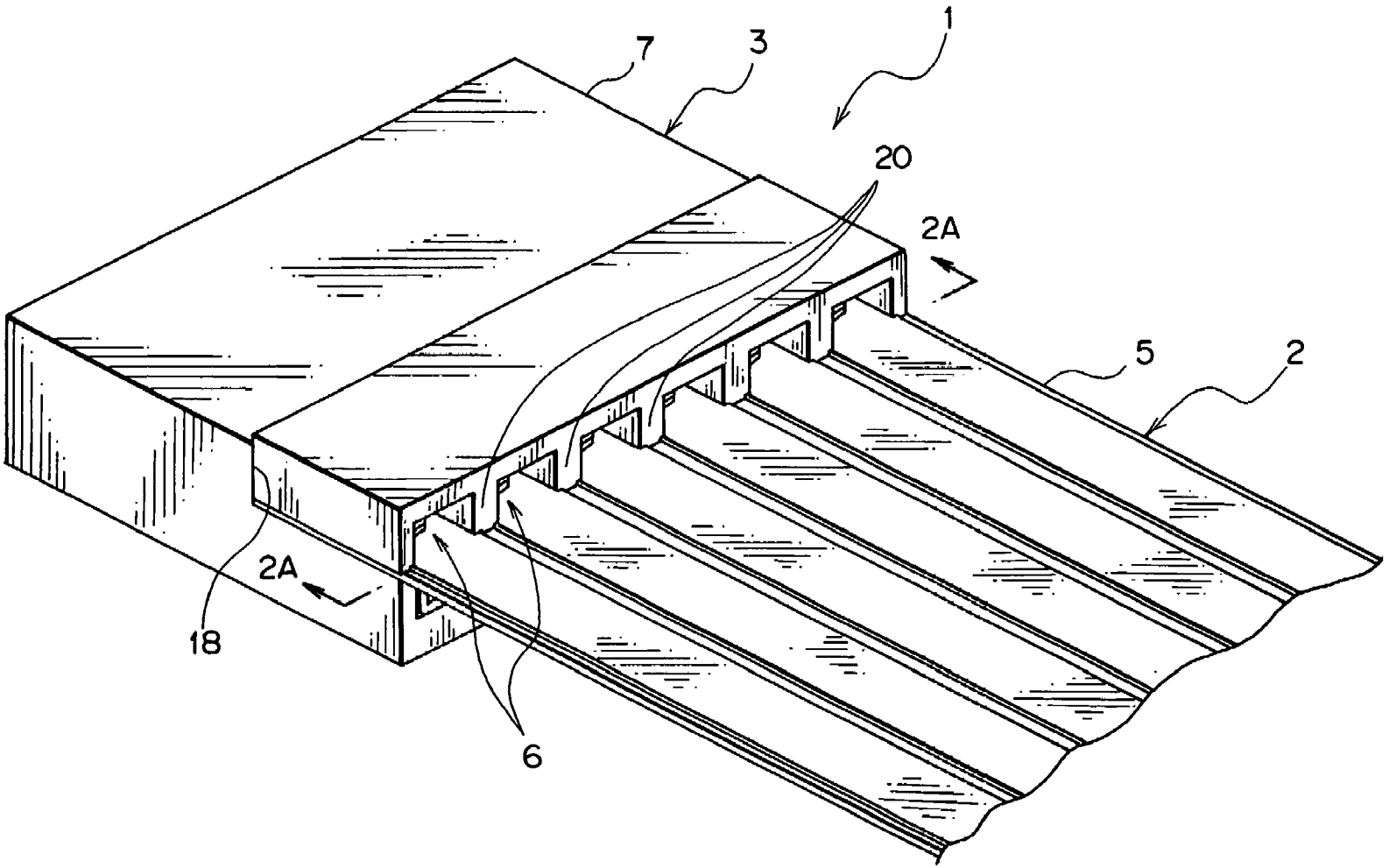
FIG. 1 is a perspective view of a wiring harness of an embodiment according to the present invention.

A wiring harness 1 includes an FFC 2 (Flexible Flat Cable) as a flat circuit body and a connector 3, as shown in FIG. 1.

Figure 2A:
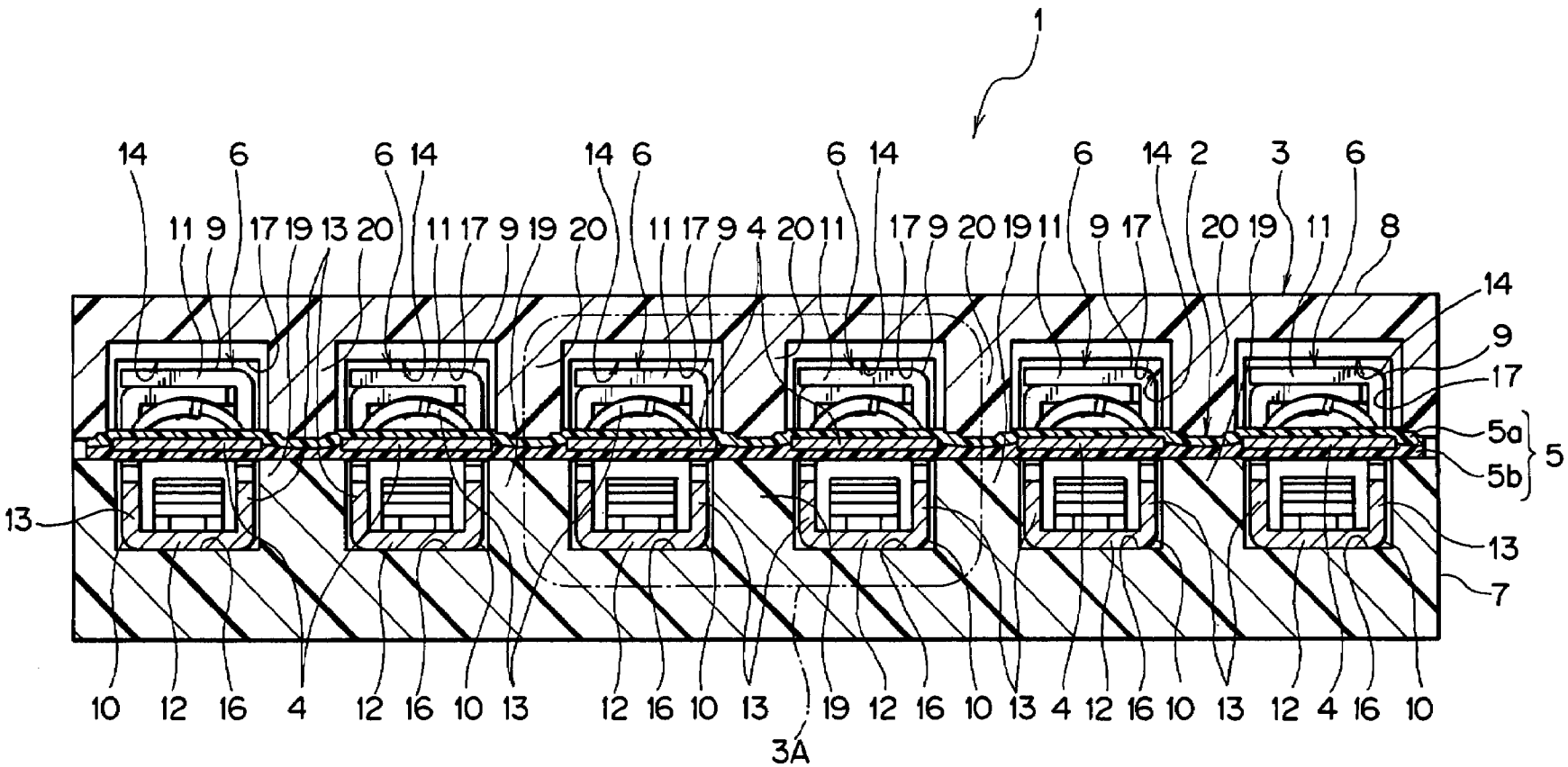
FIG. 2A is a cross-sectional view taken along the line 2A-2A in FIG. 1.
Figure 3A:
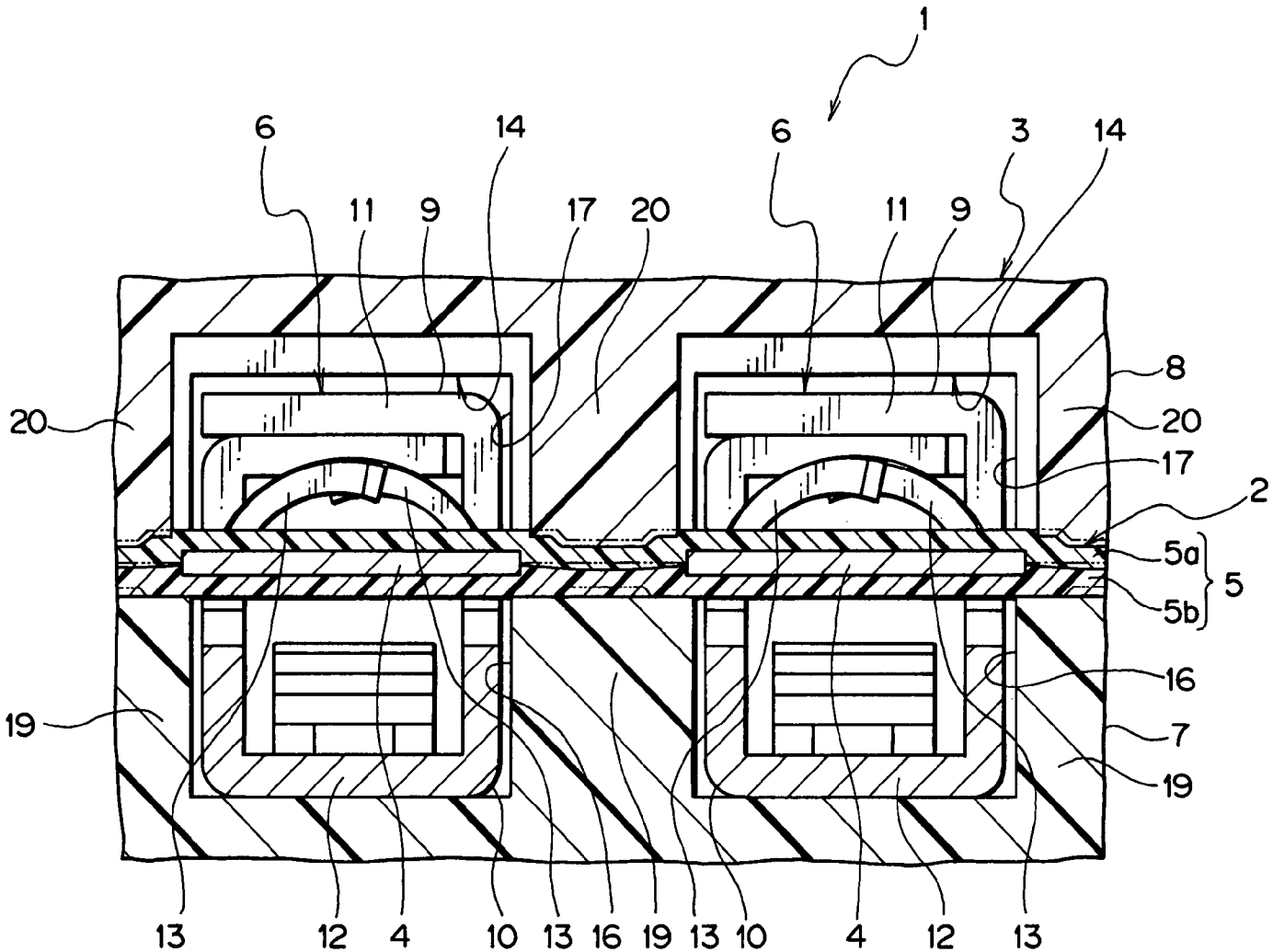
FIG. 3A is an expanded cross-sectional view of 3A area in FIG. 2A.

The FFC 3 has a plurality of conductors 4 and an insulator covering the conductors, as shown in FIGS. 2A, 3A.

The conductor 4 is made of electrically conductive metal. The conductor 4 includes at least copper or copper alloy. The conductor 4 is formed with rectangular cross-section. The conductor 4 extends linearly. The plurality of conductors 4 is arranged in parallel to each other.

An insulator 5 has a pair of insulation sheets 5*a*, 5*b*. The insulation sheets 5*a*, 5*b* are made of insulating synthetic resin and formed into band shape. The insulating sheets 5*a*, 5*b* are made of, for example, polyethyleneterephthalate; PET. The pair of insulating sheets 5*a*, 5*b* receives the plurality of conductors therebetween to cover the conductors.

The flat circuit body described herein means an object formed into flat band shape having a plurality of conductors and an insulating cover for covering the conductors.

The connector 3 has piercing terminals 6 as terminals, a connector housing 7 and a cover 8 as shown in FIGS. 2A-4.

Figure 4:
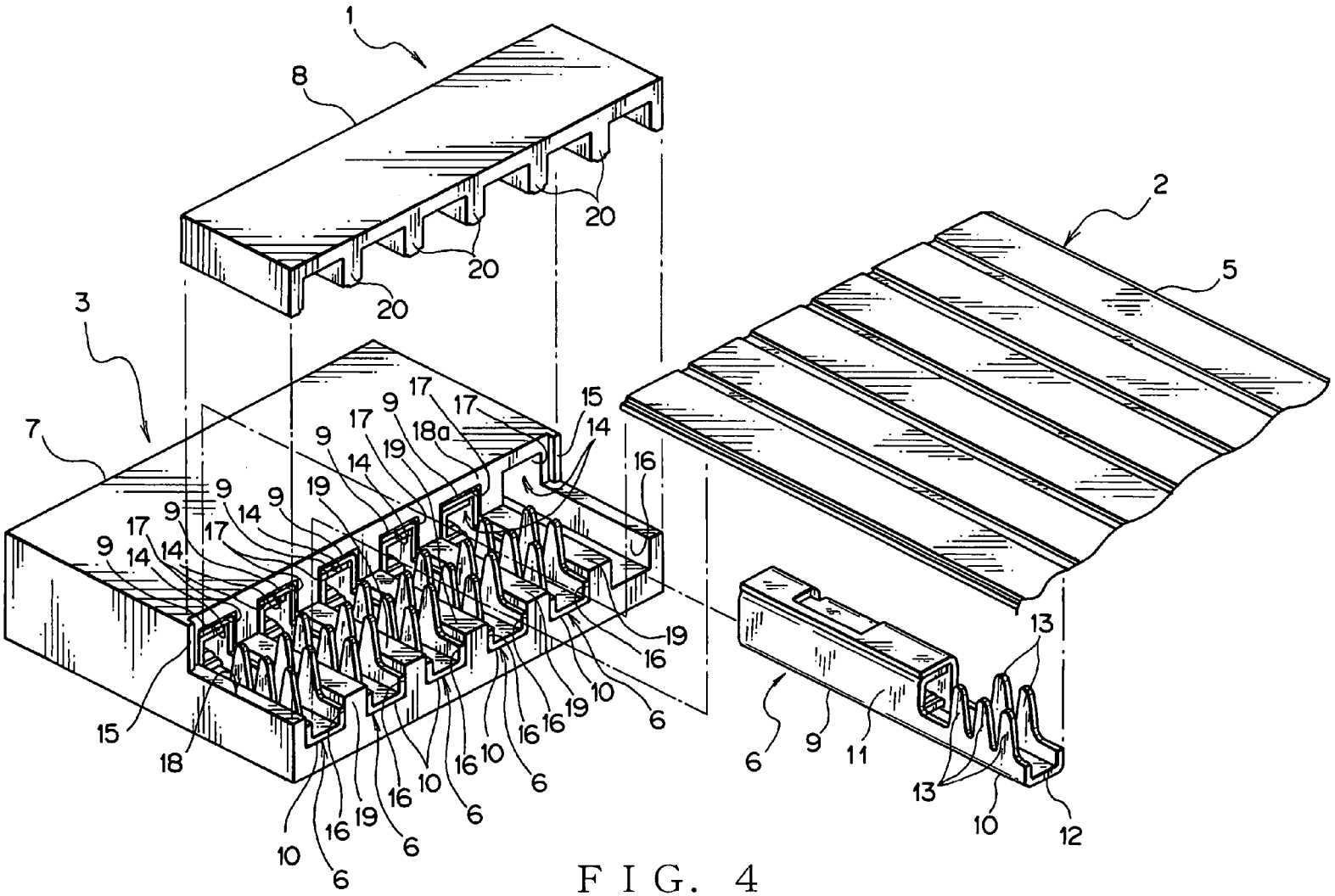
FIG. 4 is an exploded perspective view of the wiring harness shown in FIG. 1.

The piercing terminal 6 is provided by bending a conductive sheet metal. The piercing terminal 6 has an electric contact portion 9 to be connected with a mating terminal, and a wire connecting portion 10 to be joined with the conductor 4 of the FFC 2, integrally as shown in FIG. 4.

The electric contact portion 9 has a rectangular tube portion 11 and a spring piece (not shown) to be received in the tube portion 11. In the embodiment, the tube portion 11 is formed into a squarer tube shape. The spring piece pushes an insert element, which penetrates into the tube portion 11, such as a male tab of the mating terminal toward an inner wall of the tube portion 11 to clamp it between the inner wall and the spring piece. Thus, the insert element of the mating terminal inserted into the tube 11 is clamped between the spring piece and the inner wall of the tube 11, so that the electric contact portion 9 is connected electrically and mechanically with the mating terminal.

The wire connecting portion 10 has a bottom wall 12 and a plurality of claws 13 standing from both side edges widthwise of the bottom wall 12. The bottom wall 12 is continued to an outer wall of the tube 11. The plurality of claws 13 is arranged along a lengthwise of the bottom wall 12, that is the piercing terminal 6. The opposite claws 13 are provided alternately. The claws 13 standing from the both side edges of the bottom wall 12 pierce into the insulator 5 and the conductor 4 of the FFC 2, and are bent so as to make a top end thereof be close to the bottom wall 12, as shown in FIGS. 2A, 3A.

The plurality of claws 13 pierces into the insulator 5 and the conductor 4 of the FFC 2 and is in contact with the conductor 4, so that the wire connecting portion 10 is electrically joined with the conductor 4. By bending the top ends of the piercing claws 13 inwardly to each other, the wire connecting portion 10 is connected mechanically with the FFC 2.

The connector housing 7 is made of insulating synthetic resin and is formed into a flat rectangular box shape. The connector housing 7 has a plurality of terminal receiving sections 14 and a pair of positioning projections 15 as a positioning member.

The terminal receiving section 14 is a linearly extending space. The plurality of terminal receiving sections 14 is arranged in parallel to each other. Each terminal receiving section 14 receives each piercing terminal 6. The terminal receiving section 14 includes a connecting portion receiving groove 16 for receiving the wire connecting portion 10 of the piercing terminal 6 and a contact portion receiving section 17 for receiving the electric contact portion 9 of the piercing terminal 6.

The connector housing 7 is provided with a cutout 18. The cutout 18 is formed so as to cut out the connector housing 7. The cutout 18 exposes the wire connecting portion 10, which is received in the connecting portion receiving groove 16 of the terminal receiving section 14, toward a direction perpendicular to the bottom wall 12 and outwardly from the connector housing 7. In other wards, the cutout 18 exposes the wire connecting portion 10 at a side of the claws 13 standing from the bottom wall 12, outwardly from the connector housing 7. The connector housing 7 is provided with a flat step wall 18*a* along a direction intersecting ("perpendicular" in the embodiment) to a surface of the bottom wall 12 of the piercing terminal 6 received in the terminal receiving section 14, by the cutout 18. The step wall 18*a* is arranged between the connecting portion receiving groove 16 and the contact portion receiving section 17.

The positioning projections are provided at both sides of the step wall 18*a* in a direction of widthwise of the FFC 2 to be connected with the piercing terminals 6 received in the terminal receiving sections 14. The pair of positioning projections 15 is arranged in an interval to each other along the direction of widthwise of the FFC.

The positioning projections 15 are formed to project from the step wall 18*a* toward an end of the wire connecting portion 10 of the piercing terminal 6 received in the terminal receiving section 14. A dimension of positioning projection 15 projecting from the step wall 18*a* allows to bend the claws 13 of the piercing terminals 6 received in the terminal receiving sections 14. A distance between the pair of positioning projections 15 substantially equals the width of the FFC 2. The pair of positioning projections 15 positions the FFC 2 at a position where each conductor 4 can be connected with the wire connecting portion 10 of the piercing terminal 6 by placing the FFC 2 therebetween.

The cover 8 is made of an insulating synthetic resin and formed into a multiple gutter shape. The cover 8 is mounted on the connector housing 7 to cover the cutout 18. When the cover 8 is mounted on the connector housing 7, the cover 8 covers the connector housing 7 and the wire connecting portions 10 of the piercing terminals 6.

The connector housing 7 and the cover 8 are provided respectively with a separating wall 19, 20 as a clamping portion. The separating wall 19 of the connector housing 7 is arranged in a plural number at an area of connecting portion receiving groove 16 of the terminal receiving section 14. The separating wall 19 extends along lengthwise of the terminal receiving section 14, that is lengthwise of the conductor 4 of the FFC 2 connected with the wire connecting portion 10 of the piercing terminal 6. The separating walls 19 partition the terminal receiving sections 14 to each other. In other words, the adjacent separating walls 19 form the connecting portion receiving groove 16 of the terminal receiving section 14. Only insulator 5 of the FFC 2 connected with the wire connecting portion 10 of the piercing terminal 6 is positioned on a surface of the separating wall 19 by partitioning the terminal receiving sections 14. In other words, the conductors 4 of the FFC 2 are not positioned on the surface of the separating walls 19.

The separating walls 20 of the cover 8 are arranged at positions to correspond to the separating walls 19 of the connector housing 7 when the cover 8 is mounted on the connector housing 7. The separating wall 20 extends along lengthwise of the terminal receiving section 14, that is lengthwise of the conductor 4 of the FFC 2 connected with the wire connecting portion 10 of the piercing terminal 6. Only insulator 5 of the FFC 2 connected with the wire connecting portion 10 of the piercing terminal 6 received in the terminal receiving section 14 is positioned on a surface of the separating wall 20. In other words, the conductors 4 of the FFC 2 are not positioned on the surface of the separating walls 20.

When the cover 8 is mounted on the connector housing 7, a space between the separating walls 19 of the connector housing 7 and the separating walls 20 of the cover 8 is slightly smaller than a thickness of the only insulator 5 of the FFC 2. Thereby, when the cover 8 is mounted on the connector housing 7, the separating walls 19, 20 clamp the only insulator 5 of the FFC 2 therebetween, and deform to make the insulator 5 thinner from a condition shown with a long dashed double-short dashed line in FIG. 3A to a condition shown with a continuous line in FIG. 2A.

The connector housing 7 and the cover 8 are respectively provided with a lock portion (not shown) to lock each other. By locking the lock portion to each other, the cover 8 is locked on the connector housing 7.

The wiring harness mentioned above will be assembled as following steps. The piercing terminals 6 are inserted into the terminal receiving sections 14 of the connector housing 7. Placing the wire connecting portion 10 in the connecting portion receiving groove 16 and placing the electric contact portion 9 in the contact portion receiving section 17, the piercing terminal 6 is received in the terminal receiving section 14. All terminal receiving sections 14 receives each piercing terminal 6. Thus, the piercing terminals 6 are assembled in the connector housing 7.

Figure 5:
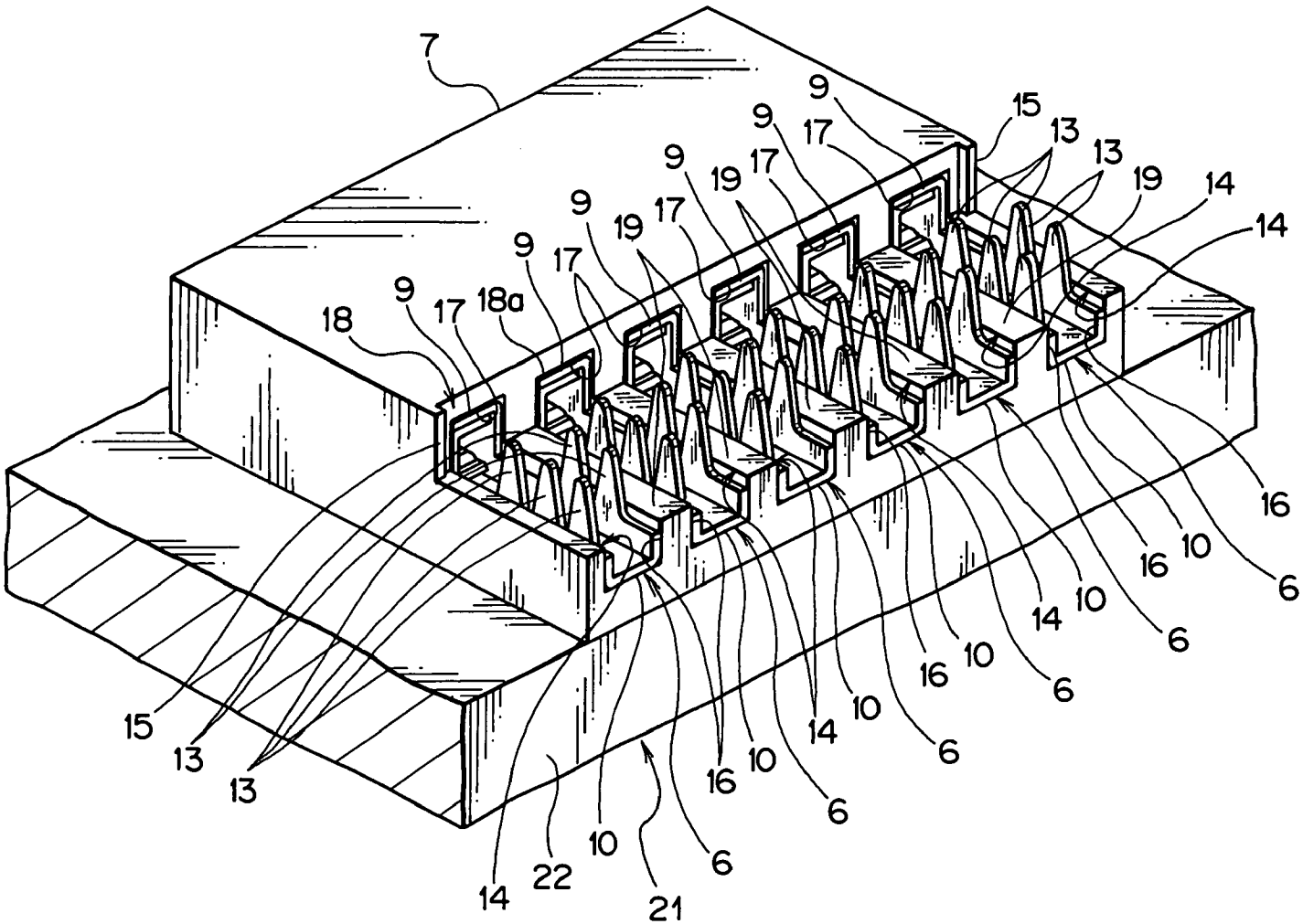
FIG. 5 is a perspective view of a connector housing, in which piercing terminals of the wiring harness shown in FIG. 1 are inserted, mounted on a base.

The connector housing 7, in which the piercing terminals 6 were mounted, is placed on a base 22 of a pressure welding machine 21, as shown in FIG. 5. The pressure welding machine 21 is for making the claws 13 pierce the FFC 2 pierce and fixing the claws 13 to the FFC 2.

Figure 6:
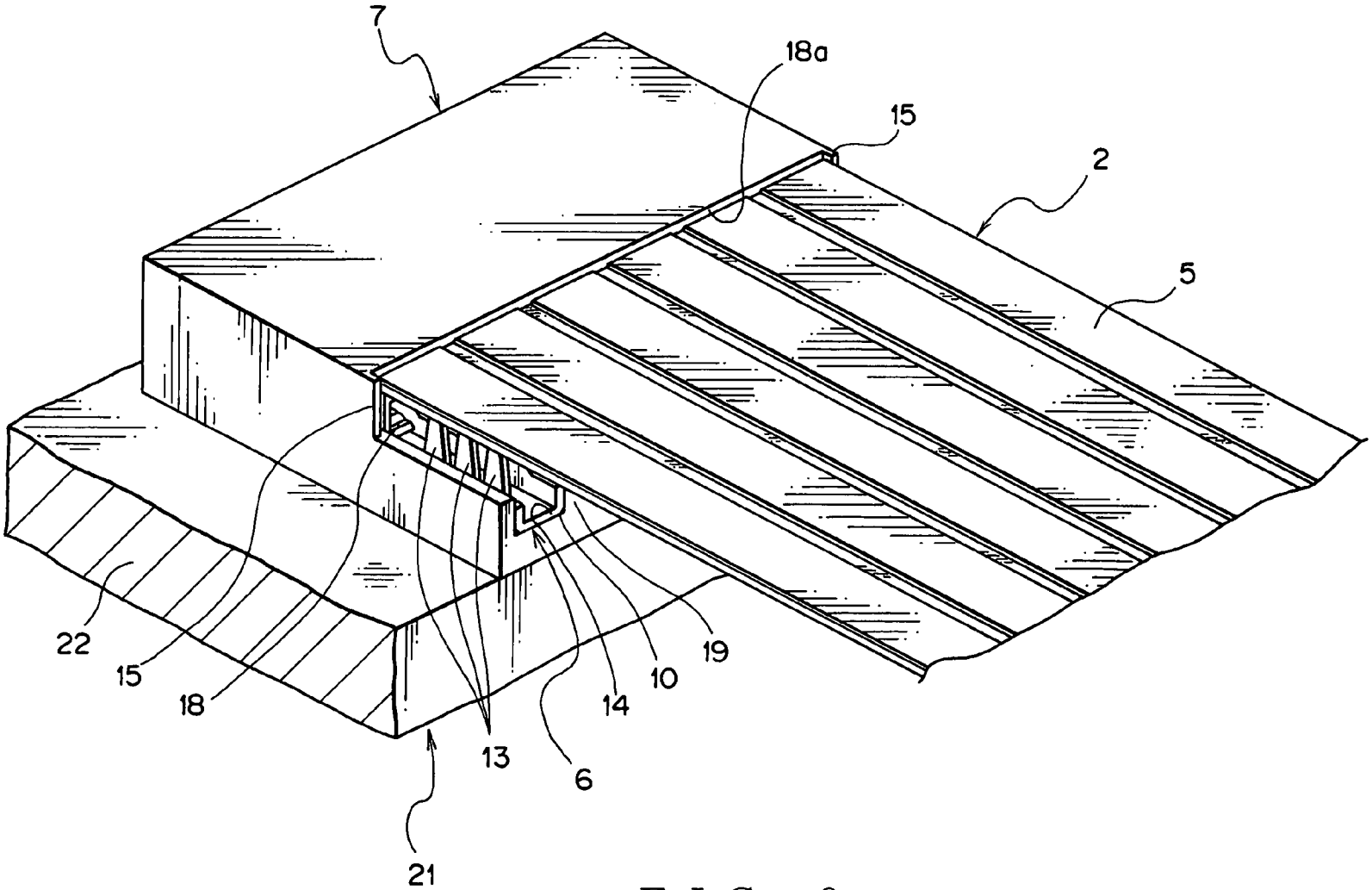
FIG. 6 is a perspective view of piling an FFC on wire connecting portions of the piercing terminals shown in FIG. 5.
Figure 7:
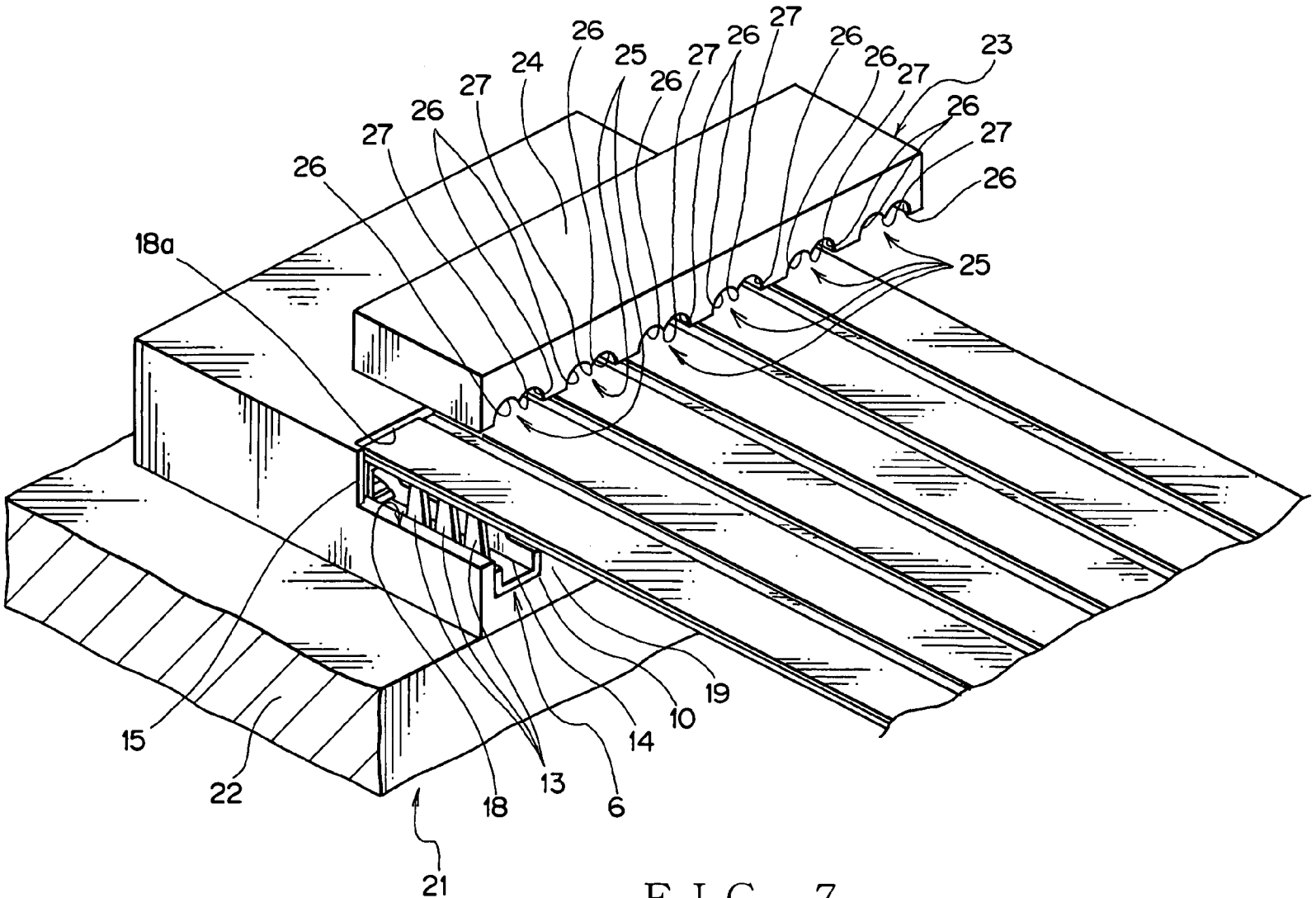
FIG. 7 is a perspective view of arranging a die above a front end of the FFC on the wire connecting portions of the piercing terminals shown in FIG. 6.

The FFC 2 is positioned on the cutout 18 of the connector housing 7 by the pair of positioning projections 15 so as to place the end of the FFC 2 between the positioning projections 15 as shown in FIG. 6. A die 23 of the pressure welding machine 21 is arranged corresponding to the cutout 18 of the connector housing 7 and lengthwise of the piercing terminal 6 received in the terminal receiving section 14.

Figure 10:
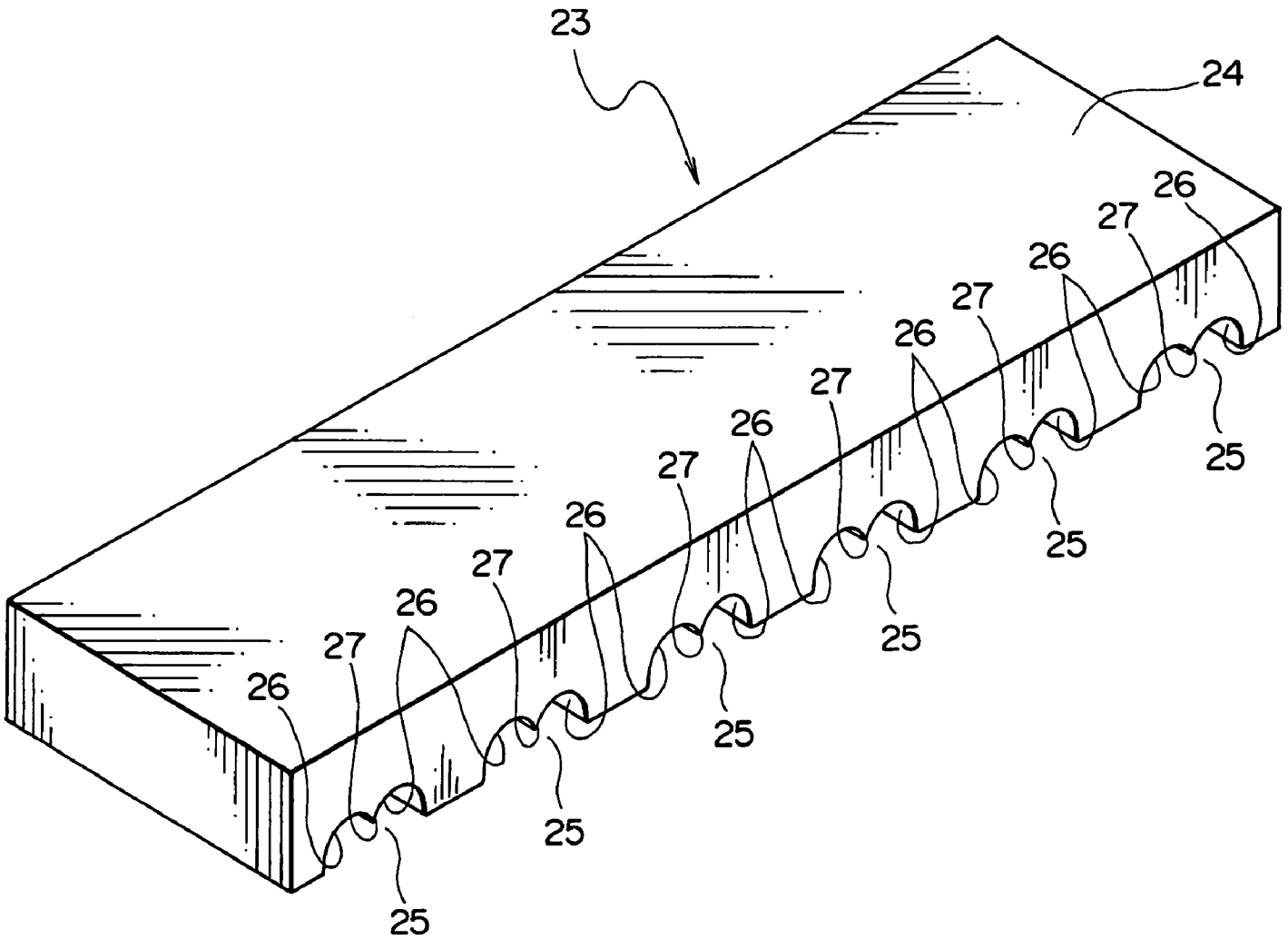
FIG. 10 is a perspective view of the die shown in FIG. 7.

The die 23 has a main body 24 formed into a plate shape and a plurality of cavities 25 provided on the main body 24, as shown in FIG. 10. The same number of the cavities 25 as a number of piercing terminals 6 received in the terminal receiving sections 14 is provided. When the die 23 is arranged corresponding to the cutout 18 of the connector housing 7, the cavities 25 is positioned corresponding to the wire connecting portions 10 of the piercing terminals 6.

The cavities 25 dent from a surface, corresponding to the connector housing 7, of the main body 24. A pair of curved surfaces 26 is provided on an inner surface of each cavity 25. The pair of curved surfaces 26 is arranged along the piercing terminal 6 received in the connector housing 7. The pair of curved surfaces 26 dent from the piercing terminal 6 received in the connector housing 7. A projection 27 is provided projecting toward the piercing terminal 6, received in the connector housing 7, between the pair of curved surfaces 26.

Figure 8:
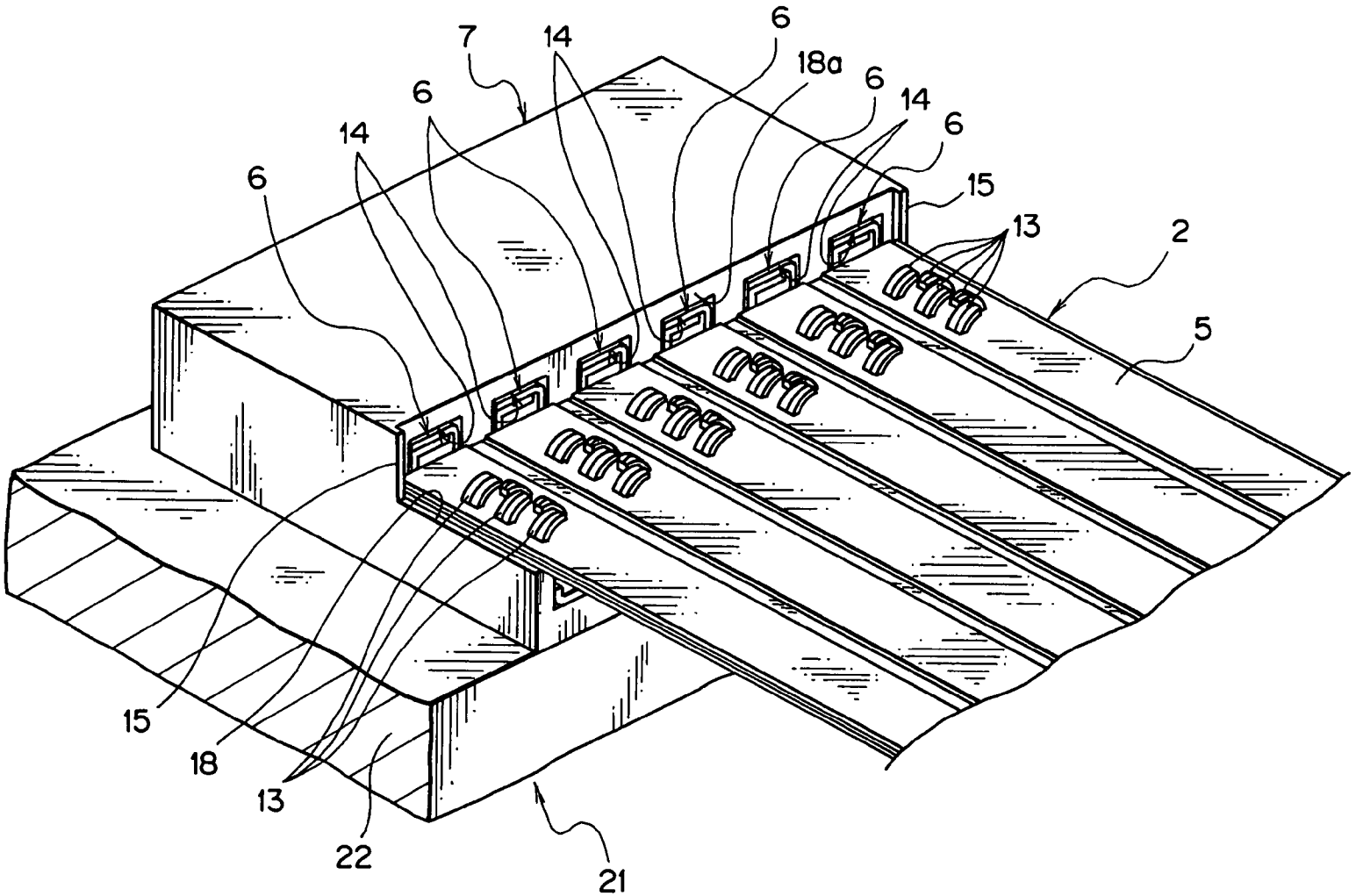
FIG. 8 is a perspective view of connecting the FFC with the piercing terminals by bending claws of the piercing terminals shown in FIG. 7.
Figure 9:
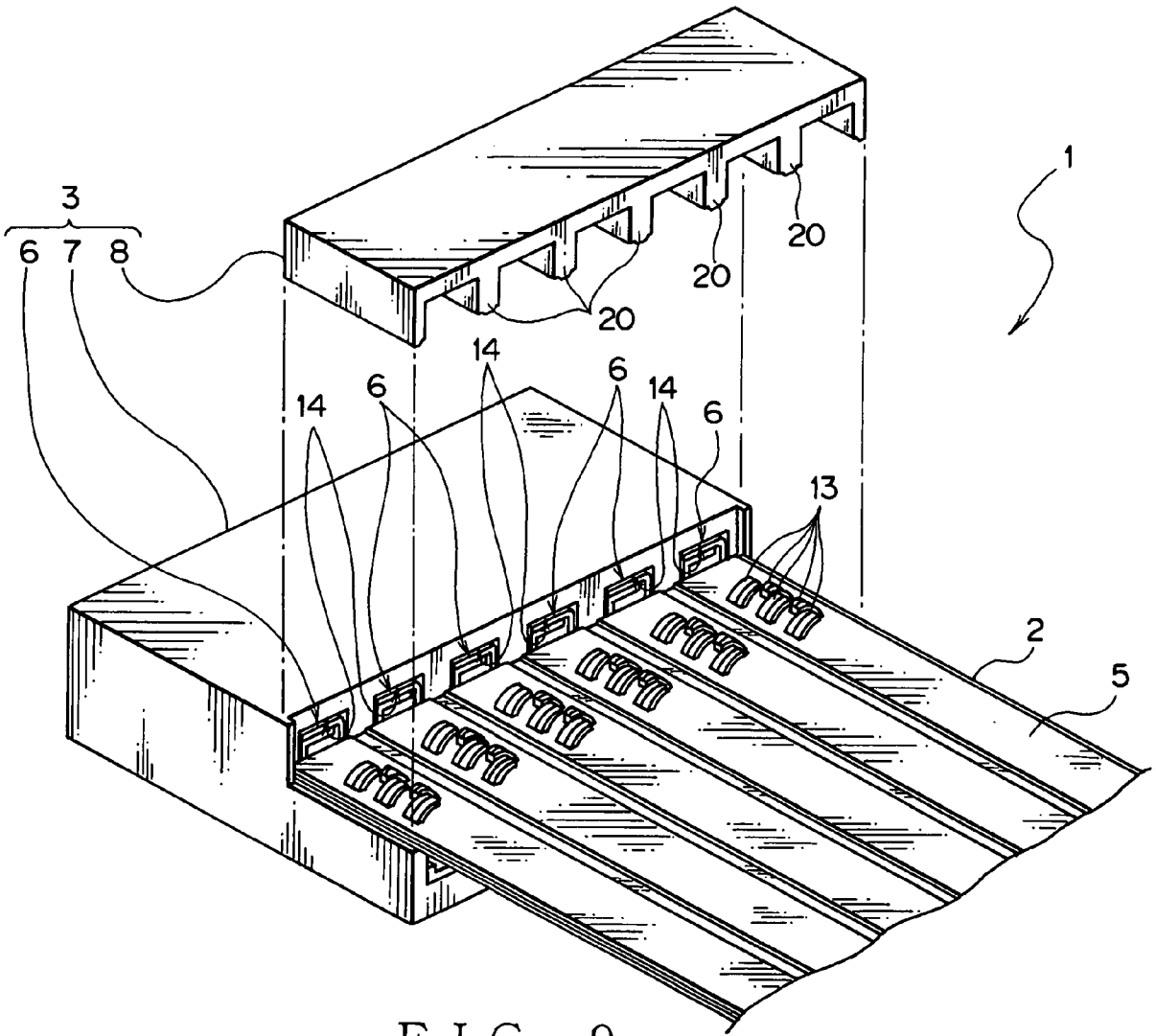
FIG. 9 is a perspective view for arranging a cover above a cutout of the connector housing shown in FIG. 8.

The die 23 of the pressure welding machine 21 is moved to approach the cutout 18 of the connector housing 7. The FFC 2 is pressed toward the wire connecting portion 10 of the piercing terminal 6 by the die 23. Thereby, the claws 13 pierce through the insulator 5 and the conductor 4 of the FFC 2 and the claws 13 penetrate into the cavities 25. The top ends of the claws 13 are deformed along the curved surfaces 26 provided on the inner surface of the cavity 25 to be bent to make the top ends near to the bottom wall 12. When the die 23 approaches the connector housing 7, the claws 23 are bent completely and fixed with the FFC 2 as shown in FIG. 8. Thereafter, the die 23 is moved away from the connector housing 7. The connector housing 7 is removed from the base 22 and the cover 8 is mounted on the connector housing 7 as shown in FIG. 9. Thus, the wiring harness 1 mentioned above is assembled.

By inserting the plurality of piercing terminals 6 in the connector housing 7, piling the FFC 2 on the wire connecting portions 10 of the plurality of piercing terminals 6, making the claws 13 of the wire connecting portions 10 pierce through the conductor 4 of the FFC 2, bending the piercing claws 13, and fixing the plurality of piercing terminals 6 received in the connector housing 7 with the FFC 2, the wiring harness 1 is assembled. The wiring harness 7 assembled as mentioned above is wired in the car to make the connector 3 connect with a connector of an electronic apparatus installed in the car.

According to the embodiment, by inserting the plurality of piercing terminals 6 in the connector housing 7, the FCC 2 can be connected in one lump with the wire connecting portions 10 of the plurality of piercing terminals 6. Thereby, required hours of process for connecting the FFC 2 with the wire connecting portion 10 of the piercing terminals 6, that is process for assembling the wiring harness, can be extremely reduced.

Since the FFC 2 is connected simultaneously with the wire connecting portions 10 of the plurality of piercing terminals 6, the die 23 used for connecting the FFC 2 with the wire connecting portions 10 can be designed large to have the same size as the dimension of combining the plurality of piercing terminals 6.

Thereby, the mechanical strength of the die 23 can be increased, and life of the die 23 can be extended. Therefore, frequency of changing the die 23 used for the process of connecting the FFC 2 with the wire connecting portions 10 can be reduced, and cost for assembling the wiring harness 1 can be reduced.

The connector housing 7 is provided with the cutout 18 exposing the wire connecting portions 10 of the piercing terminals 6 inserted in the connector housing 7. Thereby, by piling the FFC 2 on the wire connecting portions 10 of the piercing terminals 6 and pressing the FFC 2 toward the wire connecting portions 10, the FFC 2 can be connected with the wire connecting portions 10. Therefore, without removing the insulator 5 between adjacent conductors 4 at the front end of the FFC 2, the FFC 2 can be connected with the piercing terminals 6. Thereby, required hours for connecting the FFC 2 to the wire connecting portions 10 of the piercing terminals 6, that is assembling the wiring harness 1, can be extremely shortened.

The connector 3 has the positioning projections 15 as the positioning member for positioning the FFC 2, so that the positioning projections 15 positions the FFC 2 at the position in the connector housing 7 where each conductor 4 can be connected with the wire connecting portion 10 of the piercing terminal 6. since the FFC 2 is prevented from displacing from the connector housing 7, each conductor 4 of the FFC 2 can be connected securely with the wire connecting portion 10 of each piercing terminal 6.

Since the only insulator 5 of the FFC 2 is clamped between the separating wall 19 of the connector housing 7 and the separating wall 20 of the cover 8, if relative displacement between the connector housing 7 and the FFC 2 is changed, transmitting the change of the relative displacement between the connecting point of the conductor 4 of the FFC 2 and the piercing terminal 6 can be prevented. Thereby, the conductors 4 of the FFC 2 can be connected securely with the piercing terminals 6, and unstable connection thereof can be prevented.

Since the separating walls 19, 20 of plural number are respectively provided, if the relative displacement between the connector housing 7 and the FFC 2 is changed, transmitting the relative displacement to the connecting point of the conductor 4 of the FFC 2 and the piercing terminal 6 can be prevented securely. Thereby, unstable connection of the conductor 4 of the FFC 2 and the piercing terminals 6 can be prevented securely.

Since each separating wall 19, 20 extends linearly along lengthwise of the conductor 4, contact area of the separating walls and the insulator 5 of the FFC 2 can be increased. Since the separating walls 19, 20 of plural number are respectively provided, the relative displacement between the connector housing 7 and the FFC 2 can be prevented more securely from transmitting to the connecting point of the conductor 4 of the FFC 2 and the piercing terminals 6, and unstable connection thereof can be prevented more securely.

In the embodiment, the FFC 2 is applied as the flat circuit body. According to the present invention, any other belt shape flat circuit body, such as a FPC (Flexible Printed Circuit), can be used.

In the embodiment, the electric contact portion 9 of the piercing terminal 6 is tubular female contact type. According to the present invention, the electric contact portion 9 of the piercing terminal 6 can be pin or plate male contact type.

Although the present invention has been fully described by way of examples with reference to the accompanying drawings, it is to be noted that various change and modifications can be made with the scope of the present invention.

What is claimed is:

1. A wiring harness comprising:

a flat circuit body having a conductor and an insulator covering the conductor;

a terminal having a wire connecting portion to be connected with the conductor of the flat circuit body, said wire connecting portion having a claw; and a connector housing to receive a plurality of said terminals, wherein the plurality of terminals is inserted into the connector housing, and the flat circuit body is piled on the wire connecting portions of the plurality of terminals, and the claw of the wire connecting portion pierces into the conductor of the flat circuit body, and the claw is bent so as to connect the plurality of terminals inserted in the connector housing and the flat circuit body.

2. The wiring harness according to claim 1, wherein said connector housing has a positioning member for positioning the flat circuit body in a position allowable to connect each conductor and the wire connecting portion of the terminal.

3. The wiring harness according to claim 2 further comprising a cover being mounted on the connector housing for covering the wire connecting portion of the terminal connected with the flat circuit body, wherein the connector housing and said cover are provided respectively with a clamping portion to clamp only the insulator of the flat circuit body therebetween.

4. The wiring harness according to claim 3, wherein the clamping portions of plural number are provided at the connector housing and the clamping portions of plural number are provided at the cover.

5. The wiring harness according to claim 4, wherein each clamp portion provided at the connector housing and each clamp portion provided at the cover extend linearly along lengthwise of the conductor of the flat circuit body.

6. The wiring harness according to claim 1, wherein the connector housing has a cutout exposing the wire connecting portions of the terminals inserted in the connector housing.

7. The wiring harness according to claim 2, wherein the connector housing has a cutout exposing the wire connecting portions of the terminals inserted in the connector housing.

8. The wiring harness according to claim 3, wherein the connector housing has a cutout exposing the wire connecting portions of the terminals inserted in the connector housing.

9. The wiring harness according to claim 4, wherein the connector housing has a cutout exposing the wire connecting portions of the terminals inserted in the connector housing.

10. The wiring harness according to claim 5, wherein the connector housing has a cutout exposing the wire connecting portions of the terminals inserted in the connector housing.

* * * * *